United States Patent [19]

Hayashi et al.

[11] 4,026,703

[45] May 31, 1977

[54] DUAL-LAYERED PHOTORECEPTOR USE IN ELECTROPHOTOGRAPHY

[75] Inventors: Yoshiki Hayashi, Hirakata; Masanaru Hasegawa, Kadoma; Takeo Fusayama; Kazuhiko Kosuge, both of Otsu; Kenji Hayashi, Kyoto, all of Japan

[73] Assignee: Matsushita Electric Industrial Co., Ltd., Japan

[22] Filed: Mar. 26, 1975

[21] Appl. No.: 562,152

[30] Foreign Application Priority Data

Mar. 29, 1974 Japan ..... 49-36305

[52] U.S. Cl. ..... 96/1.5; 204/38 R; 204/38 S; 427/76; 204/192 P; 427/74; 427/83; 427/86

[51] Int. Cl.[2] ..... G03G 5/02

[58] Field of Search ..... 96/1.5, 1.5 C; 204/192, 204/38 R, 38 S; 427/76, 74, 83, 89

[56] References Cited

UNITED STATES PATENTS

| | | | |
|---|---|---|---|
| 3,037,861 | 6/1962 | Hoegl et al. | 96/1.5 |
| 3,484,237 | 12/1969 | Shattuck et al. | 96/1.5 C |
| 3,725,058 | 4/1973 | Hayashi et al. | 96/1.5 |
| 3,771,866 | 11/1973 | Ogawa | 96/1.5 C |
| 3,801,368 | 4/1974 | Fusayama et al. | 204/192 |
| 3,850,629 | 11/1974 | Ogo et al. | 96/1.5 |

FOREIGN PATENTS OR APPLICATIONS

| | | | |
|---|---|---|---|
| 16,198 | 7/1968 | Japan | 96/1.5 |

*Primary Examiner*—Thomas J. Herbert, Jr.
*Attorney, Agent, or Firm*—Wenderoth, Lind & Ponack

[57] ABSTRACT

An electrophotographic photoreceptor for producing an electrostatic latent image on the top layer thereof which comprises from the bottom up:

a. a substrate
b. a layer of metallic palladium having a thickness of from 5A to 1000A,
c. a layer including vitreous selenium having a thickness of from 0.05 to 3 microns and
d. a top layer including polyvinyl carbazole having a recurring unit of the formula:

wherein X is a member selected from a group consisting of hydrogen, halogen, nitro, alkyl, aryl, alkyl aryl, amino and alkylamino.

8 Claims, 10 Drawing Figures

DUAL-LAYERED PHOTORECEPTOR USE IN ELECTROPHOTOGRAPHY

BACKGROUND OF THE INVENTION

This invention relates to an electrophotographic photoreceptor, and more particulary the invention relates to an improved dual-layered photoreceptor employing vitreous selenium as a photosensitizing layer and a polymeric carbazole derivative as a charge-retaining and charge-transport layer. The photoreceptor has a long shelf-life with high stability in repeated use.

Conventionally, it is known that a dual-layered photoreceptor can basically be formed by overlaying a thin vitreous selenium layer on an electrically conductive support either directly or indirectly through an electrical barrier layer and then overlaying a relatively thick top layer of an electron-doner type organic polymeric carbozole derivative, such as poly-N-vinyl carbazole, which is substantially non-light sensitive in the visible ray region, but exhibits the ability to transport the charge carriers generated in said adjacent selenium layer, when subjected to an actinic light.

The detailed descriptions of the prior art concerned with the dual-layered photoreceptor are found, for example, in U.S. Pat. No. 3,725,058 and 3,850,629, South African Pat. No. 7,101,218 and Preprint of Annual Conference: Society of Photographic Scientists and Engineers, page 116 to 117, June 1972.

The polymeric carbazole derivative (hereinafter conveniently called "polyvinyl carbazole") referred to herein, is designated as a polymer of vinyl carbazole and/or its derivative, or a copolymer of N-vinyl carbazole or its derivative and another vinyl compound, such as vinyl acetate and methyl methacrylate. The derivative referred to herein has a substituent, such as a halogen atom, nitro radical, alkyl aryl radical, amino radical or alkylamino radical, in place of a hydrogen atom in a carbazole ring in the recurring unit of the above mentioned polymers, as shown in the following chemical formula:

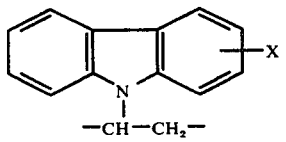

wherein, $^{X}$ is the substituent. The number and position of said substituents in the carbazole ring and the polymerization degree of the resultant polymer are determined according to the method for preparing them and are not limited to those expressively disclosed herein.

It is known that the polyvinyl carbazole used in this dual-layered photoreceptor does not necessarily contain a Lewis acid and/or a sensitizing dye, because the polyvinyl carbazole layer is optically sensitized by the said selenium layer, intimately attached thereto. On the contrary, addition of sensitizers sometimes causes a disadvantage for the completed dual-layered photoreceptor for the reason that some well-known sensitizers effective to sensitize a polyvinyl carbazole single layer photoreceptor (of U.S. Pat. No. 3,037,861 and 3,484,237) act as light filters for the selenium layer or act as charge-traps for the present polyvinyl carbazole charge-transport layer. However, when the polyvinyl carbazole layer requires plasticizers and/or film-forming binders to increase flexibility and film-strength, addition of some specified active additives are sometimes effective in order to prevent an increase of residual voltage of the completed dual-layered photoreceptor in repeated use.

These improvements concerned with the dual-layered photoreceptor are described in the aforesaid U.S. Pat. No. 3,850,629.

The operable thickness of the selenium layer, as taught by the aforesaid U.S. Pat. No. 3,725,058, is from 0.05 to 3 $\mu$. A selenium layer thinner than 0.05 $\mu$ shows a marked reduction in the photosensitivity of the completed dual-layered photoreceptor. A selenium layer thicker than 3 $\mu$ shows a relatively high residual voltage and brittleness.

It has been known that metallic aluminum is the most preferable material for an electrode of an electrophotographic photoreceptor employing vitreous selenium, because it is easy to fabricate at a low cost, and further because the completed photoreceptor shows a high chargeability in the dark, due to a barrier layer produced between the aluminum and the selenium. Although the metallic aluminum is an advantageous material for electrodes, as described above, it sometimes injures the adjacent vitreous selenium layer as time passes, if the selenium layer is thinner than 3 $\mu$. The following is an example of the prior art described above.

A vitreous selenium layer of 0.5 $\mu$ in thickness is vapor coated on a 500A thick layer of metallic aluminum, which has also been vapor-coated on a plastic substrate in the same vacuum jar, prior to coating said selenium without breaking the vacuum. The surface of the vitreous selenium layer changes its original reddish brown color to black in less than five hours. A completed dual-layered photoreceptor using such a black selenium does not show a normal photosensitivity any longer.

The X-ray analysis of such a black selenium shows that it belongs to the hexagonal system. When the vitreous selenium layer, and overlaying aluminum layer, is placed in air containing a humidity of 60% RH or more, tiny spots of a tree-like white crystal come out while the vitreous selenium gradually changes its reddish brown color to black. These white crystals grow as time passes, and finally, some of them form circular or fan-shape white areas of 10 to 20 mm in diameter. These seem to form spherulites.

From an electron diffraction analysis, the white crystalline material is regarded as a composite consisting of a very small amount of selenium oxide and a large amount of selenium that orients, although the degree of crystallization is not very high. The changeability of the original vitreous selenium into crystalline form is likely to be induced by the crystallization of the vapor-deposited aluminum layer. That is, the speed of crystallization in the selenium layer increases in accordance with an increase in the degree of crystallization in the aluminum layer.

If a vapor-deposited aluminum layer that has been placed for a short time in atmospheric air before selenium is coated, the overlaid vitreous selenium changes its reddish brown color into black within one day, when it is at room temperature. The white spots also come out and tend to grow when the room is more humid than 60% RH.

The conventional metallic aluminum foil, fabricated through a rolling process at high temperature from 500° to 600° C, forms a relatively thicker oxide layer on its surface, as compared with those of vacuum coated aluminum layers. When a vitreous selenium layer thinner than 3 $\mu$ is vacuum-coated on the conventional metallic aluminum foil, it partially changes its reddish brown color to black in 1 to 2 months at 30° C and in a humidity of more than 70% RH. The completed dual-layered photoreceptor using such a black selenium on the foil provides not only the absence of electrophotographic photosensitivity but also useless adhesion to the aluminum foil. Actually, the adhesion of the fresh selenium to the aluminum foil is essentially so weak that it seems to be at its lowest level for practical purposes in the reused photoreceptor. The crystallization reduces the adhesion from the lowest sufficient level to an insufficient level.

In addition, a completed dual-layered photoreceptor using a vitreous selenium which has such a black area or white spots, provides undesirable image noise expressed as background fog or white dots, when toned by ordinary electrophotographic imaging method such as magnetic brush development or liquid development. Even if the area or spot of the photoreceptor is barely visible to the naked eye, the corresponding toned noises are clearly distinguishable.

Thus, it can be said that the selenium layer, even if the thickness thereof is less than 3 $\mu$, does not adhere well to a metallic aluminum surface in general. In order to improve such a disadvantage, the surface of the aluminum is, according to prior art, roughened with mechanical scribing, chemical etching and electrochemical etching, or cleaned by a physical method such as ionic bombardment and electron-beam bombardment. This treatment of the metallic aluminum surface as above requires equipment and man-power which will increase expense of the completed dual-layered photoreceptor. In the art of xerography, a single vitreous selenium layer of thickness of from 20 $\mu$ to 50 $\mu$ which is mechanically brittle is commonly used as xerographic photoreceptor. To prevent crock generation in the selenium layer, which relates to the layer separation from the substrate, the xerography employs a thick and rigid plate or drum of metallic aluminum as a substrate. In spite of employing such a rigid aluminum substrate in xerography, there have been many attempts to improve the adhesion strength between the xerographic vitreous selenium and the rigid aluminum substrate, such as forming an oxide layer by chemical or physical treatment, or pre-coating a thin layer of a different material before coating selenium. The reason for requiring such a pre-treatment of the xerographic aluminum may be (1) to increase adhesion strength and (2) to prevent crystallization or chemical change of the vitreous selenium.

As mentioned in the foregoing example, pure and fresh metallic aluminum has a general tendency to promote the crystallization or chemical change of the vitreous selenium intimately attached thereto.

Especially in the case of a selenium layer thinner than 3 $\mu$ such as a layer used in the dual-layered photoreceptor in the present invention, adhesion between the vitreous selenium and a substate is a more serious problem that with the xerographic rigid plate, because the present dual-layered photoreceptor is largely characterized by its flexibility. Thus, the xerographic aluminum plate or drum that is the most commonly useful material for a photoreceptor employing vitreous selenium is still on unsatisfactory material for the present dual-layered photoreceptor.

The summary of the above description is that, when metallic aluminum is employed as an electrode material of a dual layered photoreceptor by overlaying a vitreous selenium layer directly and further overlaying a polyvinylcarbazole layer thereon, is that (1) it plays the role of a catalyst to promote a physical and/or chemical change of the adjacent selenium layer and (2) it provides unsatisfactory adhesion to the adjacent selenium layer.

If such a dual-layered photoreceptor is reused many times in an electrophotographic office copying machine, it may easily be damaged by miscellaneous factors such as light, electrical field, corona ion, heat, mechanical stress, humidity and if used, a solvent. Some of these factors are continuously and some are intermittently applied to the dual-layered photoreceptor.

Conducting materials other than aluminum have been also reported to serve as an electrode of an electrophotographic photoreceptor employing vitreous selenium. Known materials include (1) a metallic material such as copper, zinc, nickel, iron, chromium, indium, tin, titanium silver, gold and a metallic ally thereof and (2) inorganic semiconductive materials such as copper iodide and tin oxide.

However, they are rarely useful for the present dual-layered photoreceptor because of at least one of the following reasons. They:

(1)show a weak adhesion between the overlaid selenium and the said material, (2) provide a poor chargeability to the completed dual-layered photoreceptor, (3) acting as a catalyst for a physical or chemical change of the overlaid selenium and (4) react with the overlaid selenium on aging.

SUMMARY OF THE INVENTION

It is, therefore, an object of the present invention to provide an electrophotgraphic dual-layered photoreceptor overcoming the above noted disadvantages.

Another object of the present invention is to provide an electrophotographic dual-layered photoreceptor which is flexible as well as strong in its interlayer adhesion.

It is still another object of the present invention to provide an electrophotographic dual-layered photoreceptor which is light-transmissive.

It is still another object of the present invention to provide an electrophotographic dual-layered photoreceptor suitable for fabrication at low cost.

The foregoing objects and others are achieved according to the present invention by providing a dual-layered photoreceptor through the following fabrication process: coating a substrate with a thin metallic palladium layer of thickness of from 5 to 1000A by a vapor-depositing method, then applying a thin vitreous selenium layer of thickness of from 0.05 to 3 $\mu$ which serves as a photosensitizer intimately on the palladium layer by a vapor-deposition method, and further applying an intimate overcoat of a relatively thick organic layer of charge-transporting polyvinyl carbazole by a conventional lacquer coating method. The completed, novel, dual-layered photoreceptor, which, according to the present invention, employs a thin metallic palladium layer as a conducting electrode, exhibits outstanding long shelf life and durability even under undesirable physical and chemical factors as mentioned before. Thus, it can be used as a reusable photoreceptor element of an image transfer type copying machine. Further, as it exhibits superior interlayer adhesion between the said palladium layer and the said selenium layer, it can be made in the form of a flexible belt which provides more freedom for the designing of a copying machine. Still further, as it can be formed into a light-transmissive photoreceptor, it can be utilized for an elctrophotographic imaging system (1) of reflex type or (2) having a light illumination station at the back face of the photoreceptor.

BRIEF DESCRIPTION OF THE DRAWINGS

These advantages of the present invention will become apparent upon consideration of the following disclosure of the invention, especially when taken in conjunction with the accompanying drawings wherein.

DETAILED DESCRIPTION OF THE INVENTION

Figure 1:
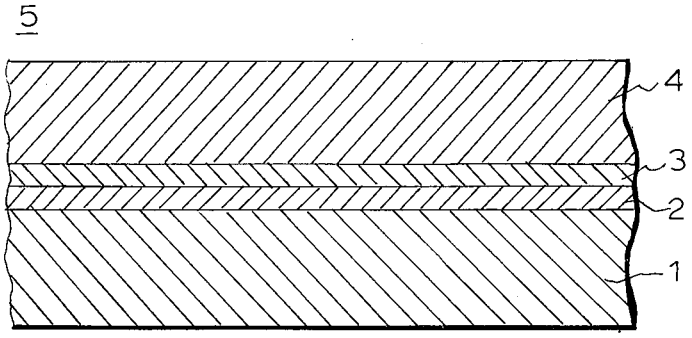
FIG. 1 illustrates a cross sectional view of a dual-layered photoreceptor according to the present invention.

In the drawing, reference character 5 in FIG. 1 illustrates one embodiment of a dual-layered photoreceptor device of the present invention. A substrate designated by a reference character 1 may be made of an electrically conducting material or insulating materials. Electrically conducting material suitable for the substrate 1 include miscellaneous metals and the alloys or chemical compounds thereof. Suitable electrically insulating materials include glass, ceramics and man-made plastics.

Even if metallic aluminum is used as a substrate 1, the present invention can be completely achieved.

A thin layer of metallic palladium designated by a reference character 2 is made from a vapor of palladium. This layer 2 may be electrically conducting or non-conducting if the substrate 1 is conducting. If the substrate 1 is electrically insulating, the layer 2 should be conducting.

A thin layer of vitreous selenium designated by reference character 3 is capable of photogenerating and injecting photoexcited charge-carriers (mainly holes) into an adjacent top layer 4. Layer 3 can be formed by depositing a vapor thereof onto the said layer 2.

The top layer 4 is an organic polyvinyl carbazole layer which is substanially non-light sensitive in the visible ray region and is able to transport the said photogenerated charge carriers at the said selenium layer to the top surface thereof when it is negatively charged.

It has been discovered according to the present invention. that the use of a very thin layer of vapor-deposited palladium as an adjacent underlayer of the vitreous selenium layer considerably improves the stability of the vitreous selenium layer. Especially, it improves the shelf-life and use-life of the selenium layer in vitreous form. Further, it has been discovered that the adhesion between said palladium layer and the selenium layer is extremely strong and that the completed photoreceptor can be applied to an image-transfer type copying machine which requires a belt type resuable photoreceptor. Also, because of its flexibility, it can easily be fabricated in a web form. This means it can be produced at low-cost in a practical industrial operation.

From the results of the experiments according to the present invention, the preferable materials for the substrate 1 are vitreous form insulating materials such as glass, and organic polymer plastics. In considering versatility of the dual-layered photoreceptor according to the present invention, more preferable materials for substrate 1 are those which are flexible and light-transmissive. Commercially available plastic films such as a film of polyethylene terephthalate, polyethylene naphthalate, polycarbonate, polyimide, polyamide, polyimide-amide, cellulose acetate, polystyrene, polypropylene, polyethylene, polyvinylchloride, ABS-resin, AS-resin, polyacetal, epoxy resin, urethane resin, and heat curing polyester resin may preferably be used. Most preferable materials are a film of biaxially oriented and crystalite rich polyethylene terephthalate or naphthalate (hereinafter conveniently called PET or PEN) or a film of polyimide and copolymer thereof. It is because these polymer films show strong tensile strength, high heat durability and high transparency. In view of an electrophotographic property, it is preferable that the substrate 1 be electrically conducting. However, if the substrate 1 is an electrical insulating material, it can easily be made conducting by vapor-depositing a layer of the palladium according to the present invention, wherein the surface resistivity of the said vapor-deposited palladium layer should be less than $10^9\Omega$/square. In order to make the layer 2, known vapor-depositing arts such as a common vacuum-evaporation method utilizing electron-beam, high-frequency induction or electrical resistance as heat source, a sputtering method utilizing DC or RF as a sputtering power source, and an ionic plating method are all operable.

The melting point and the boiling point of metallic palladium are quite high viz, 1550° C and 2540° C under atmospheric pressure, respectively. Therefore, if the layer 2 of palladium is formed by the common vacuum evaporation method, the degree of pressure in the vacuum vessel should be lower than $10^{-5}$mmHg, and also the metallic palladium source should be heated effectively for a short time so as to produce an operable amount of palladium vapor. In this method, it may be preferable to apply a preliminary cleaning procedure such as ionic bombardment to the substrate 1 before depositing the palladium in order to promote adhesion between the substrate 1 and layer 2.

The most effective method of making the layer 2 is the sputtering method wherein the vapor deposition is carried out under a pressure of the order of $5 \times 10^{-1}$to $10^{-3}$mmHg of argon gas or nitrogen gas. In this method, a preliminary cleaning procedure for substrate 1 is not necessary.

Thus formed palladium layer makes the adjacent vitreous selenium layer 3 inert from physical or chemical change, and further adheres well not only to the substrate 1 but also to the overcoated vitreous selenium layer 3. Palladium metal even formed in a thin layer is inherently inert itself in atmospheric air, and therefore, it can be placed in a room for a long time period. Further, a vitreous selenium layer 3 which is deposited on the thin palladium layer 2 is, as described before, stable and can also be placed as it is in a room for a long time period without severe care. This fact is an advantage for the dual-layered photoreceptor in industrial production.

The reason why the thin vapor-deposited palladium layer makes the vitreous selenium layer inert is unknown. However, it is assumed that the palladium layer may act as an inhibitor (or a negative catalyst) for the vitreous selenium which has an inherent tendency to change in quality. The operable thickness range of the layer 2 is between 5 and 1000A, and the preferable thickness is from 10 and 1000A. If the thickness exceeds 1000A, the layer 2 is reduced in its inhibitary action on the instability of the layer 3 due, perhaps, to its change in structure and surface activity. In addition layer 2, if thicker than 1000A, causes a separation of the said layer from the substrate 1 due to the intralayer crazing in the layer 2.

The preferable thickness is, as described before, on the order of 10 to 100A where the corresponding surface resistivity thereof is found to be from 10 to $10^6\Omega$ per square. In this region, the resultant dual-layered photoreceptor exhibits excellent electrophotographic characteristics regardless of whether substrate 1 is electrically conducting or insulating.

A typical example of a material preferably used for the substrate 1 is a flexible PET film which has a white light transmittance of about 90% or more. When it is covered with the layer 2 of thickness between 5 and 1000A, the white light transmittance through the substrate 1 and the layer 2 is found to be between 50 and 80%. Thus, a completed flexible dual-layered photoreceptor employing such a transparent PET produces an excellent electrostatic image with an image light exposure either from top side or back side.

The identification of such a thin palladium layer can be carried out by a fluorescene-X-ray analysis. If a quantitative analysis thereof is required, use of radioactivation-analysis is preferable.

Next, the method of preparing the layer 3 comprising vitreous selenium will be described. The layer 3 of the present invention can be formed by well-known art such as a conventional vacuum evaporation method. For example, U.S. Pat. Nos. 2,739,079; 2,753,278; 2,962,376; 2,970,906 and 3,725,058 disclose such prior art.

It is also well-known from the prior art that a vitreous selenium layer for an electrophotographic photorecepter can be modified to improve its total photosensitivity and spectral sensitivity in the visible ray region by adding, homogeneously or in a form of a composition having a density gradient along the vertical direction for the layer 3, at least one effective dopant material therein.

The effective dopants are for example arsenic, tellurium, cadmium, sulfur, antomony and halogens. Such a modification method is well applied to the layer 3 of the present invention for the same purpose as that of the prior art. For example, tellurium and arsenic can be added into layer 3 in or amount of from about 5 to 40 weight percent homogeneously or in a form having a composition gradient along the deposition direction.

At any rate, kinds, amounts and composition gradient of the dopants should be determined by the required characteristics of the resultant dual-layered photoreceptor and are not limited to those expressly disclosed herein.

In order to make a modified layer 3 with the aforesaid said dopant materials, two known methods viz the alloy evaporation method and the co-evaporation method are suitable. In the former case, an alloy material comprising selenium and at least one dopant is vacuum-vapored and deposited on the layer 2. In the latter case, each material (i.e. selenium and tellurium) is placed in each heating vessel of a vacuum evaporation equipment and is heated simultaneously with heat control so as to keep a constant composition of gas mixtures of the components.

Regardless of wheather layer 3 contains such a dopant or not, it always exhibits high adhesion to the layer 2 so that it cannot easily removed from the layer 2 even when it is subjected with an adhesive tape peeling test.

Finally, a layer 4 which comprises polyvinyl carbazole and if required some additives such as binders, plasticizers and active additives, is formed by a conventional lacquer coating method. The completed dual-layered photoreceptor according to the present invention shows an excellent electrophotographic characteristic viz. high charge acceptance and low dark decay rate in the dark, and normal photodecay rate under visible ray irradiation. This electrophotographic characteristic is found to be almost the same as that of a fresh dual-layered photoreceptor using a metallic aluminum foil as layer 2.

EXAMPLE 1

In the following samples, sample G was made by the process used in the present invention, and the others were made for comparison. All the samples were made in the structure of FIG. 1, except sample H. The material used in substrate 1 was always a PET (polyethylene terephthalate) film (commercially available from Toray Inc., Japan as a trade name "Lumirror") except in sample H. Layer 3 was always made of plain vitreous selenium. The thickness of layer 3 in all the samples was kept at 0.3 $\mu$. The transparent organic layer 4, comprised of poly-N-vinyl carbazole, had a thickness of 18 $\mu$ in all the samples. The materials used and the thickness of the electrode in layer 2 are shown in Table 1.

Table 1

| Sample | Materials used in electrode layer | Thickness |
|---|---|---|
| A | Aluminum foil, soft type | 12 $\mu$ |
| B | aluminium foil, hard type | 12 $\mu$ |
| C | vapor-deposited copper | 200Å |
| D | copper iodide | about 500Å |
| E | vapor-deposited aluminum | 1500Å |
| F | vapor-deposited nickel | 500Å |
| G | vapor deposited palladium | 30Å |
| H | stainless steel foil (SUS-27) | 50 $\mu$ |

The electrode layers of the above samples shown in Table 1 were obtained by the following processes:

Electrodes for samples A and B were made by glue laminating said aluminum foil onto the PET film substrate.

The electrode for sample C was obtained by vacuum depositing copper onto the surface of said PET film. The vacuum deposition was carried out by using copper metal particles of 99.99% a purity in a vessel of a basket shaped tungsten coil heater under a vacuum of $1\times10^{-5}$mmHg. The said tungsten coil heater is made of a tungsten wire of 0.8 mm in diameter.

The electrode for sample D was made by iodizing the copper metallized PET film by immersing it in a solution comprising 10 wt.% of iodine and 90 wt.% of tetrachloromethane. Said copper-coated film for sample D was obtained by the same conditions used in sample C, except for a thickness of 100A. After completion of iodization of said copper layer, the iodized film was dryed. Thus, a transparent and electrically conductive copper iodide coated PET film was obtained, the transmission ratio of which was 90% in incandescent light.

Electrodes for samples E,F, and G were prepared by sputtering metals of aluminum, nickel and palladium onto the surface of the PET film, respectively. The said sputtering was carried out by a DC cathode method under the following conditions: The anode was made of chromium plated copper substrate, and the cathode was a plate made of the each of the above mentioned metals. The distance between the anode and cathode was always 3 cm. The inside pressure during sputtering was maintained at about $2\times10^{-2}$mmHg of argon gas. A DC voltage of 5 KV was supplied between these two electrodes. The said PET film was closely contacted with the surface of the said anode plate. Thus, each cathode metal was sputter-transferred onto the surface of the film, and a thin metal layer thereof was formed.

In the case of sample H, the stainless steel foil was used as a substrate as well as an electrode.

The vitreous selenium layer was formed by evaporating metallic selenium granules of 99.99% purity in a tungsten basket type coil heater which was made of tungsten wire of 0.5 mm in diameter. The vacuum evaporation was carried out under a vacuum of $1 \times 10^{-4}$mmHg. The vitreous selenium layer thus formed was 0.3 $\mu$ in thickness. Onto the surface of said selenium layer, an organic solution shown in Table 2 was applied and dryed. The thickness of the dryed layer was 18 $\mu$.

Table 2

| Component | Composition ratio, wt. part |
|---|---|
| poly-N-vinylcarbazole | 100 |
| polycarbonate | 30 |
| orthoterphenyl | 40 |
| diphenylmethane di-isocyanate | 3 |
| monochlorobenzene | 900 |
| dichloroethane | 300 |

Each of the above samples was then evaluated through the following tests:

Test 1: A cycle of charging in the dark and discharging by sufficient light was repeatedly applied to said sample for 10,000 times without rest in an environment at room temperature of 18° to 22° C and room humidity of 40 to 60% RH in order to estimate the use-life of the every sample. In this test, the discharge voltage applied to the corona discharger was negative DC 6KV. Surface potential in the dark $V_o$ and the residual voltage $V_r$ were alternatively measured every two cycles. The light illumination of the sample in every cycle was 200 lux for 1 second. Each cycle was repeated at a speed of 30 times per minute.

Test 2: A test was carried out under the same conditions as those of of test 1, except an environmental temperature of and here the temperature of 50° C was used and maintained.

Test 3: After the samples had been stored in an atmosphere of 50° C and 30% RH for one month, a test was carried out by the same method and conditions as those of Test 1.

Figure 2:
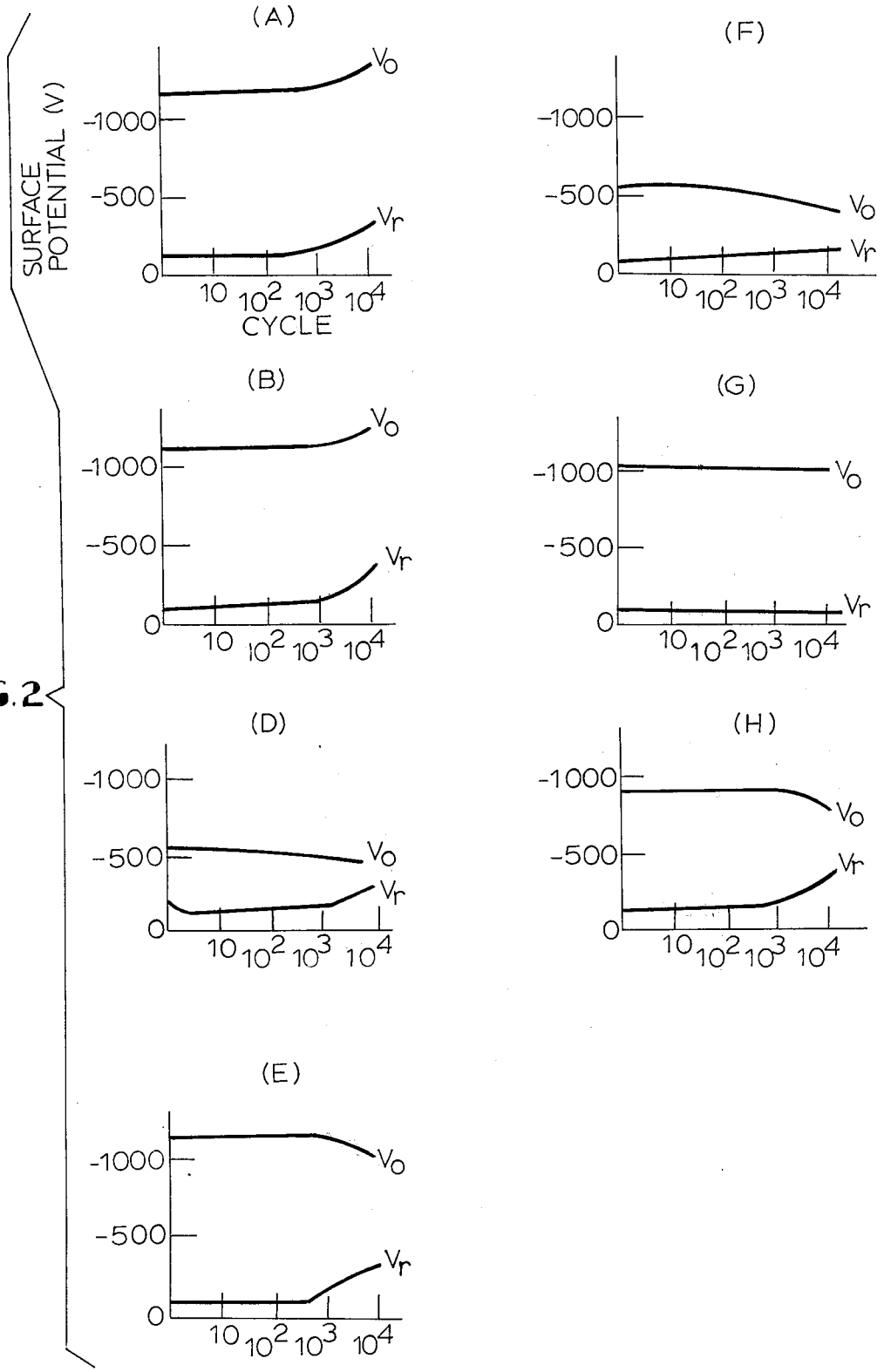
FIGS. 2, 3, 4, 5 and 10 illustrate changes of surface potential in the dark $V_o$ and residual potential after light exposure $V_r$ of the sample photoreceptors used in Examples of the following description when they are subjected to repeated test cycles by charging in the dark-discharging by light.
Figure 3:
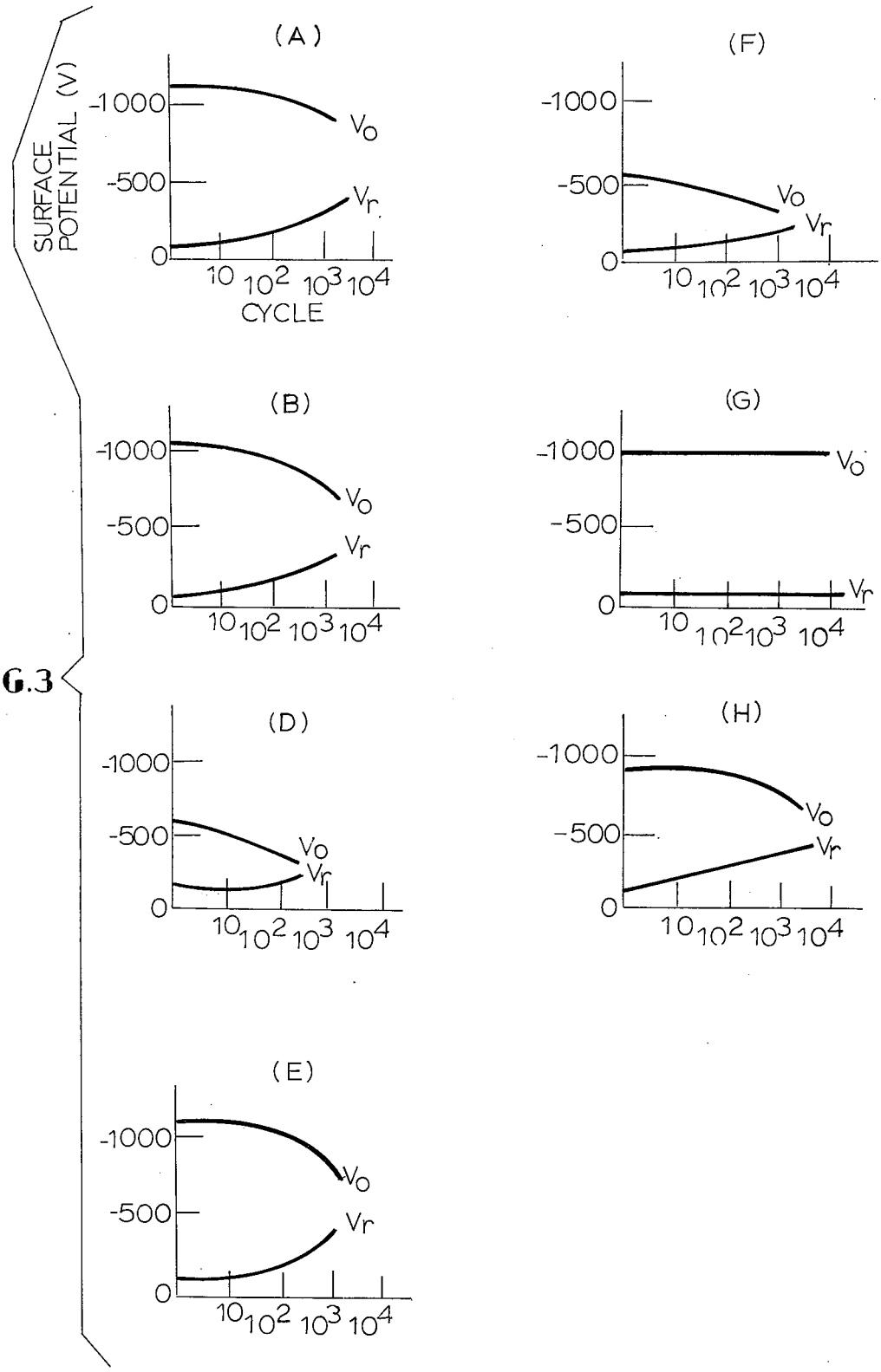
Figure 4:
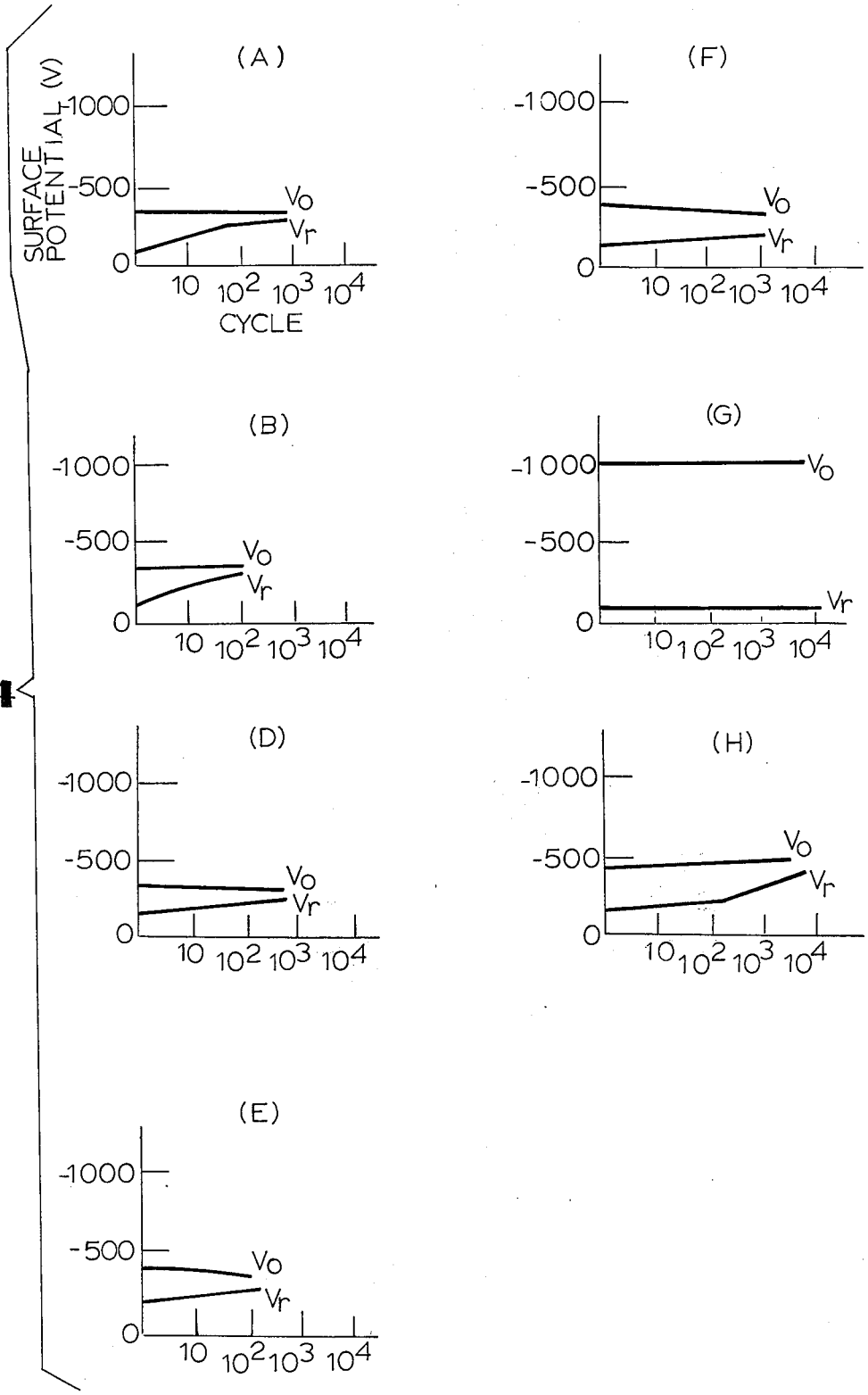

The results of Tests 1, 2 and 3 are shown in FIGS. 2, 3, and 4, respectively, as conveniently summarized in Table 3.

Table 3

| Sample | Test 1 | Test 2 | Test 3 |
|---|---|---|---|
| A | FIG. 2-A | FIG. 3-A | FIG. 4-A |
| B | FIG. 2-B | FIG. 3-B | FIG. 4-B |
| C | The selenium layer was black-colored due to a reaction between copper and selenium. The resultant dual-layered photoreceptor sample showed no chargeability in the dark | | |
| D | FIG. 2-D | FIG. 3-D | FIG. 4-D |
| E | FIG. 2-E | FIG. 3-E | FIG. 4-E |
| F | FIG. 2-F | FIG. 3-F | FIG. 4-F |
| G | FIG. 2-G | FIG. 3-G | FIG. 4-G |
| H | FIG. 2-H | FIG. 3-H | FIG. 4-H |

Test 4: In order to obtain the practical use-life of every sample, the sample is equipped in a plain paper copying machine (hereinafter conveniently called PPC copier), and by using this copier, the quality of a developed image and the copying durability of the sample photoreceptor were both evaluated. One cycle of the copying process applied to the sample in the copier consisted of the following, respectively:

1. charging negatively in the dark by a corona discharge device,
2. exposing to an image light through an original,
3. toning with a magnetic brush development,
4. transfering the imaged toner to a plain paper by negative corona discharging, and
5. cleaning the surface of said sample with a rotating fur brush.

The temperature in said copier was always kept at 35° to ° C during the test. A test chart standardized by the Electrophotography Society of Japan was used as an original for the test. The results of this test are shown in Table 4.

Table 4

| Sample | Results |
|---|---|
| A | The original color of vitreous selenium layer changed to black at about 8,000~10,000th copy. The corresponding copy image became foggy in background. |
| B | The original color of vitreous selenium changed to black at about 4,000~6,000th copy. The corresponding copy image became foggy in background. |
| C | Useless due to no charge acceptability. |
| D | The surface potential $V_o$ decreased and the optical density of the toned image become low. |
| E | The original color of vitreous selenium layer changed to black at about 2,000~5,000th copy. The corresponding copy image became foggy in background. |
| F | The surface potential $V_o$ decreased and the optical density of the toned image become low. |
| G | No change in image quality was observed between 1st copy and 20,000th copy. |
| H | The original color of vitreous selenium layer changed to black when the repeating test exceeded 5000 cycles of copying. Foggy background was observed. |

Test 5: The adhesion between each layer of said sample sheet was evaluated. A pressure sensitive tape (trade named "Scotch Tape " No. 56 commercially available from 3M Co., U.S.A.) of 1 inch width was used in this test. At first,said adhesive tape was applied to the surface of said sheet sample by hand-pressure, and then peeled off rapidly by hand from said sheet in the direction of the opposite side (180°) along the sheet surface.

Test 6: The same peeling test as test 5 was also applied to a sample of 50mm × 50mm which had been immersed in a distilled water of room temperature for 24 hours just before this test.

Tests 5 and 6 produced almost equal results, and therefore they are conveniently summarized in Table 5.

Table 5.

| Sample | Results |
|---|---|
| A | Delamination occured between the aluminum foil and the vitreous selenium layer. |
| B | Good |
| C | Delamination occured between the copper foil and the vitreous selenium layer. |
| D | Good |
| E | Delamination occured between the aluminum layer and the vitreous selenium layer. |
| F | Delamination occured between the nickel layer and the vitreous selenium layer. |
| G | Good |
| H | Delamination occurred between the stainless steel foil and the vitreous selenium layer. |

Judging from the results of Tests 1 to 6 synthetically, it can easily be understood that sample G, which is made according to this invention, gives extremely excellent properties compared with the other samples.

EXAMPLE 2

PET film "Lumirror" of 100 $\mu$ in thickness, was used as a substrate sheet. Each sheet was cut into 50 mm × 50 mm. Said sheet was placed on the surface of a cathode plate which was cooled from behind by water. As the opposite anode electrode, a palladium metal plate of purity of 99.99%, was employed. The size of this palladium plate was 60 mm × 60 mm, and the thickness was 3 mm. The distance between these two electrode plates was kept at 30 mm. A.C. voltage of 4 KV of 13.56 MHz in frequency was supplied between these two electrodes. The pressure was $3 \times 10^2$ mmHg, in argon gas. Under the above conditions, palladium was sputtered onto the surface of said sheet for 4 seconds. Then the layer of the thin palladium film was uniformly formed on the surface of said sheet.

The deposited thickness of palladium layer on said sheet was confirmed to be 35A via two methods viz. a conventional optical method and a radioactivation analysis, in which the density of the palladium layer was found to be 12.16g/cm$^3$. The transmission ratio of this palladium deposited sheet was 60% at a monochromatic light of wavelength 550 $\mu$; surface resistivity was about $2 \times 10^2\Omega$ per square. The said deposited palladium layer did not delaminate from the sheet with Test 5.

Then, the vireous selenium layer was coated onto the surface of the palladium deposited sheet by vacuum evaporation under a vacuum of $1 \times 10^{-5}$ mmHg. The temperature of the evaporation vessel was kept at 380° C. Thus, a vitreous selenium layer of about 0.4 $\mu$ in thickness was obtained. The selenium layer did not delaminate from the sheet with Test 5.

Then, the organic composition shown in Table 2 was coated onto the surface of the selenium layer and dried for 3 hours in a hot air blast oven which was always kept at 50° C. The thickness of said organic topcoat layer thus obtained was 15.5 $\mu$. This dual-layered photo-receptor is hereafter referred to as sample I.

Figure 5:
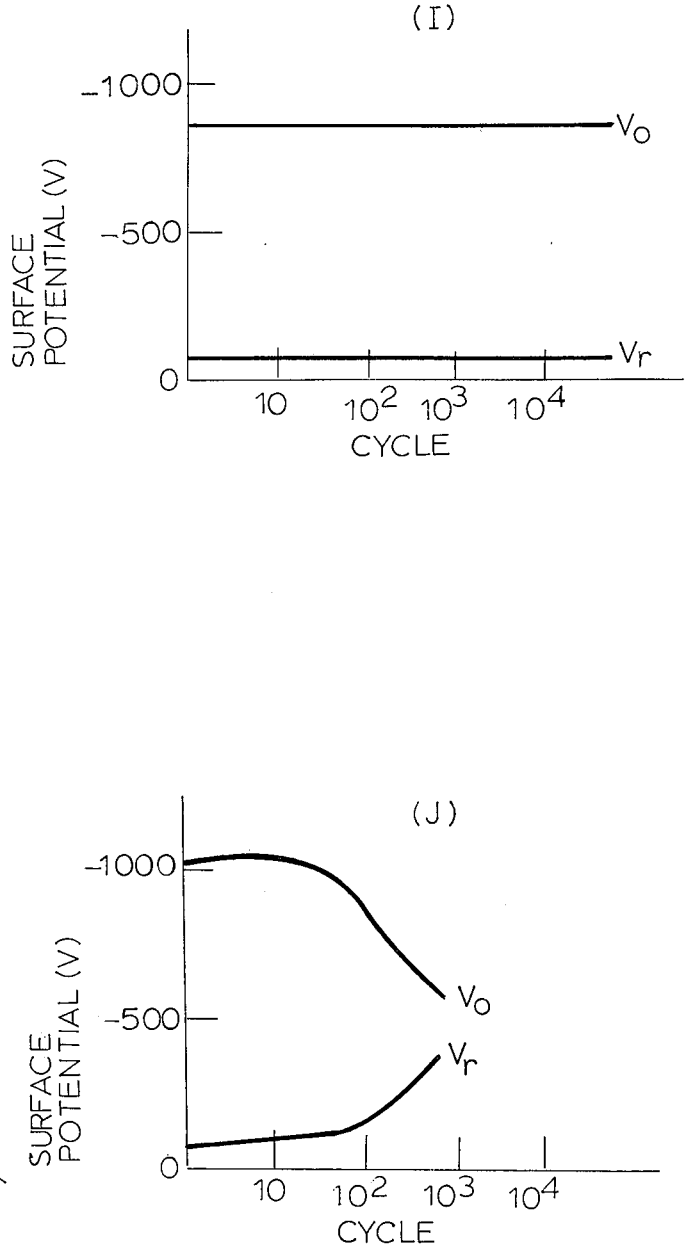

Sample I was subjected to a repeating cycle test the same as Test 3 of Example 1, where the surface temperature of Sample I was kept at 55° C. The cycle was applied to Sample I over 30,000 times without rest. The results of this repeat test are shown in FIG. 5I. As easily understood from FIG. 5I, the initial values of $V_o$ and $V_r$ are hardly changed even after the 30,000th cycle.

Meanwhile, the electrophotographic characteristic (viz. charge in the dark, dark decay and light decay) was examined with sample I. In the measurement, charge and light decay tester SP-428, which is manufactured by Kawaguchi Electrics Co. Japan, was used. The measuring conditions are as follows:

Method: Dynamic method
Corona discharge voltage: −6KV
Light source: Tungsten incandescent lamp
Color temperature: 2854° K
Intensity of illumination on the sample surface: 9.5 lux.
Light exposure per second: 3 lux. sec.

It is obvious from the results that the initial electrophotographic characteristic of sample I was unchanged even after repeating 30,000 cycles of the test.

On the other hand, sample J was prepared for comparison with sample I. Sample J was made under the same conditions as those of Sample I, except for the conditions described as follows:

PET film Lumirror of 100 $\mu$ in thickness was also used as a substrate sheet, but the surface of it was treated by ionic bombardment under vacuum of $1 \times 10^{-2}$ mmHg for 30 sec in advance. Then aluminum of 99.999% purity was vacuum-coated onto said treated surface of the sheet by vacuum evaporation, and an aluminum layer with a thickness of 500A was thus formed. By the same peeling test as Test 5, the aluminum layer was found to adhere strongly to the substrate sheet. The adhesion between the aluminum layer and the vitreous selenium layer was found to be undesirable, because about two-thirds of the applied area of selenium layer was delaminated with Test 5 of Example 1. But, the aluminum layer remained undamaged on the substrate.

Other virgin samples I and J were applied to a PPC copier, on which they were practically used as photoreceptor elements. A photoreceptor sample sheet was wound on a rotating drum of 20 cm in diameter. First, the sheet on the drum was negatively charged in the dark by a double-wired corotoron type corona discharger to which negative 7 KV was applied. Second, the sheet was subjected to light. The exposure unit was comprised of two stationary 20W FL fluorescent lamps of 20W, and a moving original station. By moving both the drum and the original station, an image light was scanned on the sheet. Third, the latent image was developed by a conventional cascade developing method using a glass bead carrier. Fourth, the developed image was transferred to a plain paper by a single-wired corotoron to which negative 7 KV was applied. The image on the paper was fixed with heat from an infrared heater. Finally, the used sheet was cleaned with a rotating fur brush and was refreshed. The copy speed of this copier was 12 copies per minute.

Samples I and J of the same size were simultaneously tested with this copier by placing them parallelly on the rotating drum. The surface potential given to samples I and J in the dark in this copier were negative 750 to 800 volts and 900 to 950 volts, respectively, at ordinary room conditions. In the copying test, the two sample sheets were raised to 55° C, and the temperature was kept constant during the test. A test chart standardized by the Electrophotographic Society of Japan was employed as an original.

In the case of Sample I, no essential difference was found between the printed image of the first copy and the 10,000th copy. When a deposited thin toner film was removed every 5,000 cycles by wiping with a soft cloth, a difference in image quality could hardly be found between the first copy and the 20,000th copy.

In the case of sample J, a slight fogging became visible on the printed paper at about 100th copy. At about 1,000th copy, contrast of the printed image was notably reduced and the fogging on the background became dense, and so the quality of the printed image became very poor. The delaminations of vitreous selenium layer of sample J were found here and there, but the area of each delaminated part was small. Those delaminations were obviously caused by mechanical friction produced during developing and cleaning in the copier. These delaminated parts made white noises on the corresponding printed images.

Figure 6:
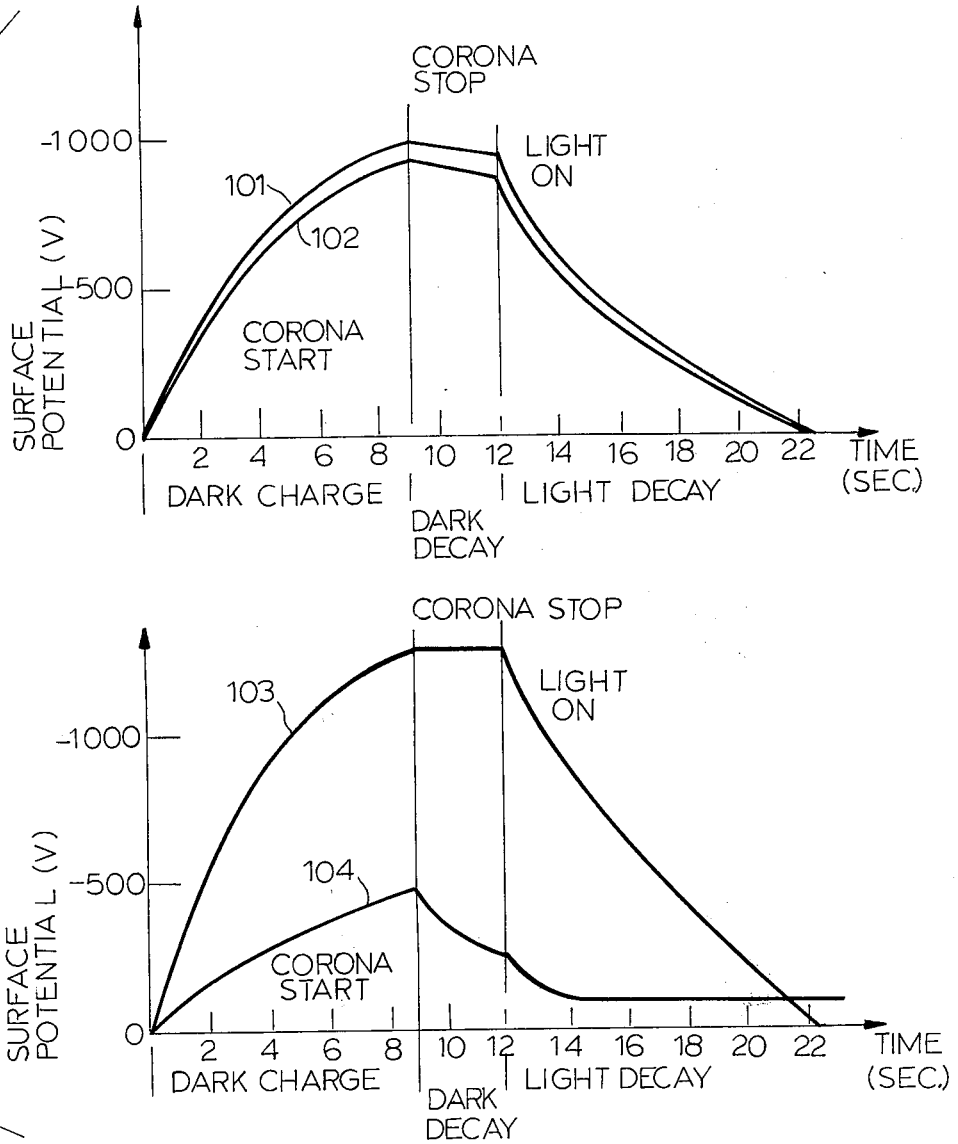
FIGS. 6, 7, 8 and 9 illustrate the electrophotographic characteristic (viz. charge in the dark, dark decay, and light decay) of the sample photoreceptors used in the Examples of the following description.

Furthermore, an area where the black colored selenium was clearly observable by the naked eye gave a slightly toned background at the corresponding location on the printed paper, where the paper had to be white due to the whiteness of the original. Charging in the dark-dark decay-light decay test was then carried out with regard to the above black area that had been caused by repeating 4000 copies. The results are shown by a curve 104 in FIG. 6J. Comparing to a curve 103 of the initial characteristic, the curve 104 shows a reduced chargeability, high dark decay rate and high residual potential.

In addition, the same examination as Test 1 was applied to sample J by maintaining the surface temperature of the specimen at 55° C. As shown in FIG. 5J, surface potential $V_0$ in the dark was decreased in a short time. On the contrary, residual potential $V_r$ in the sufficent light was found to be increased. The difference between samples I and J was easily understood from a comparison of both properties shown in FIGS. 5I and 5J.

White and tree-like crystals were found here and there after a virgin Sample J had been kept in the room for 3 months, where the relative humidity was 40 to 60 %. They were obviously recognized to be a material resulting from a change in the vitreous selenium. When a finger slightly touched the white area, the whitened selenium layer together with the organic top layer was easily separated locally.

EXAMPLE 3

Polyimide film (commercially available from Du Pont de Nemours Co., U.S.A. under the commercial name "Kapton") of 100 $\mu$ in thickness was used as a substrated sheet. The size of said sheet was B-4 size (25.7 cm × 31.4 cm). At first, the surface of said sheet was treated by $10^{-2}$ mmHg with an electric field of A.C. 60Hz. After this treatment, the vacuum was increased to $6 \times 10^{-6}$ mmHg and then palladium was coated by vacuum evaporation. The purity of said palladium was 99.999%. Said palladium was heated in a basket type tungsten coiled heater which was made of a tungsten wire of 0.8 mm in diameter.

The transmissivity of an incandescent light through this palladium deposited sheet was 30 ~35%. The surface resistivity of the palladium layer was $10 \sim 10^2 \Omega$/square, which was enough for an electrode used in an electrophotographic photoreceptor. Said palladium layer showed no delamination from the said substrate sheet with the above mentioned adhesive tape peeling test.

Onto the surface of said palladium layer, vitreous selenium of 0.3 $\mu$ in thickness was vacuum evaporated by the same process as Example 2. Then the solution shown in Table 6 was coated onto the surface of said vitreous selenium layer, and was dried in a blast oven which was kept at 40° C. The thickness of the organic topcoated layer was 12 $\mu$. The completed dual-layered photoreceptor sample sheet thus obtained is hereinafter referred to as sample K.

Table 6

| Component | Composition ratio, wt. part |
|---|---|
| poly-N-vinylcarbazole "Luvican M-170" (the product of BASF, West Germany) | 100 |
| monochlorobenzene | 900 |
| dichloroethane | 300 |

For comparison, a reference photoreceptor was made by using a hard type rolled aluminum as a substrate as well as an electrode. The surface of said aluminum foil was treated by ionic bombardment prior to the selenium coating. Then a vitreous selenium layer of 0.3 $\mu$ in thickness was overlaid by the same method as that of sample K. This vitreous selenium layer was found to strongly adhere to said aluminum foil and was not separated by the peeling test above described. When the said ionic bombardment treatment was omitted, the vitreous selenium layer was, of course, easily separated from the aluminum foil.

Next, the solution in Table 6 was topcoated and dried by the same method as that of sample K. The dried layer was 12 $\mu$ in thickness. A completed dual-layered photoreceptor thus obtained is hereinafter called sample L.

Figure 7:
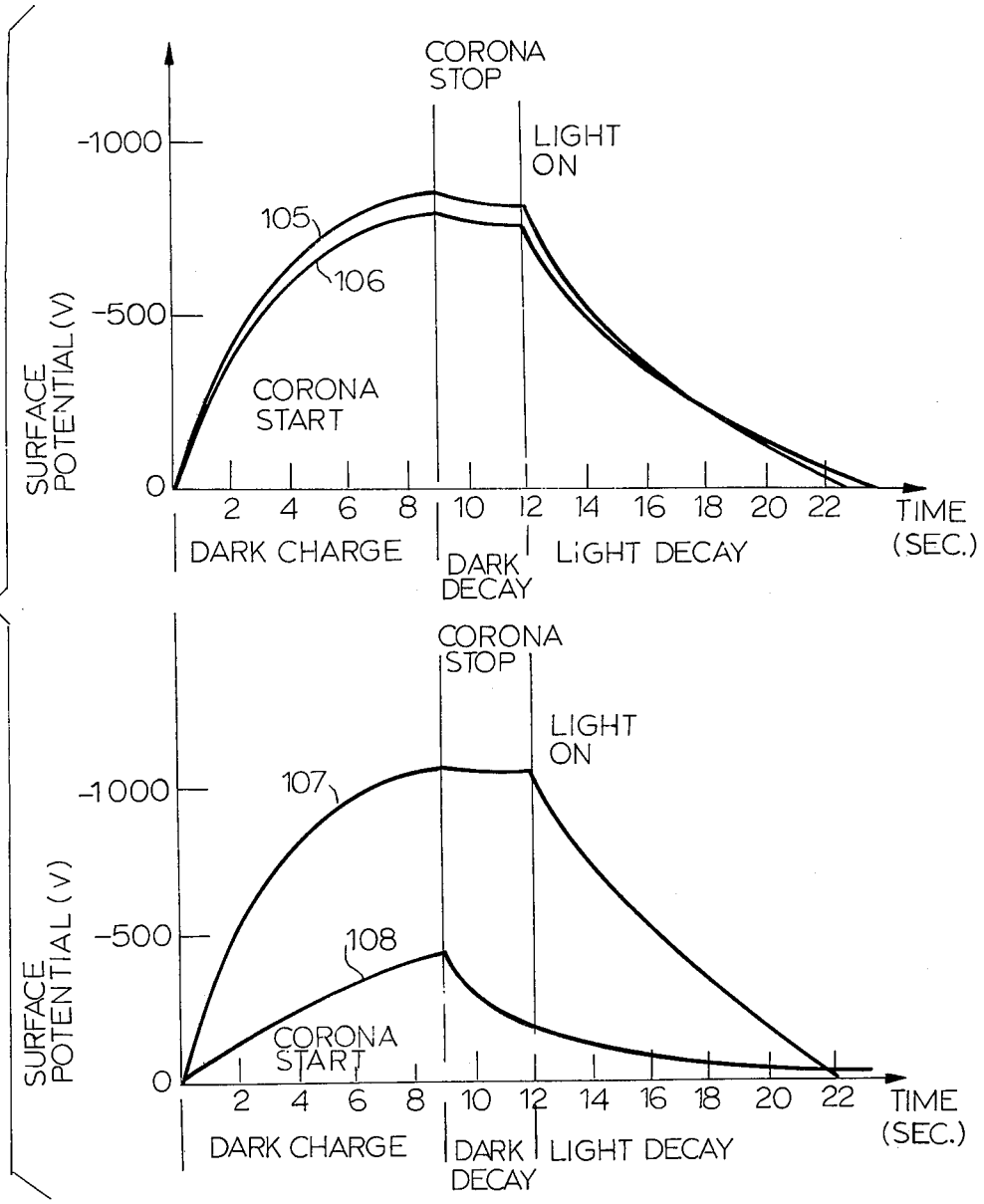

Just after the completion of samples K and L, they were subjected to the test of charge in the dark-dark decay-light decay and then both of them were kept in a room at 45° C and in humidity of 90% RH for 200 days to investigate the aging effect. The characteristics of Sample K are shown in FIG. 7K, wherein curves 105 and 106 show those before and after aging, respectively. From this, it can be understood that sample K almost maintains its initial property even under conditions of high temperature and high humidity.

In FIG. 7L, curves 107 and 108 also show those properties of sample L before and after aging, respectively. In the case of aged sample L, the chargeability becomes lower, and the difference can hardly be distinguished between dark decay and light decay, that is to say, an important ability necessary for an electrophotographic photoreceptor was almost lost. A whole area of the selenium layer of sample L was slightly tinged with black, On the contrary, any no visible change was observed for sample K.

EXAMPLE 4

The palladium and then the selenium layer were coated onto the surface of PET film Lumirror by the same conditions as those in Example 2, and the solution shown in Table 7 was coated and dried. Thus the completed dual-layered photoreceptor of the invention was obtained. The thickness of said dried topcoat layer was 12 $\mu$. The above sample is called Sample M hereinafter. For comparison with this, Sample N was prepard by the same methods as those of sample J except that the material of FIG. 7 was used for the organic top layer.

Table 7.

| Component | Ratio of composition (weight parts) |
|---|---|
| Brominated poly-N-vinyl carbazole (Bromination : 100 mol. %) | 100 |
| Polycarbonate (Makrofol G. Bayer, West Germany) | 20 |
| Diphenylmethane di-isocyanate | 3 |
| Monochlorobenzene | 900 |
| Dichloroethane | 300 |

Figure 8:
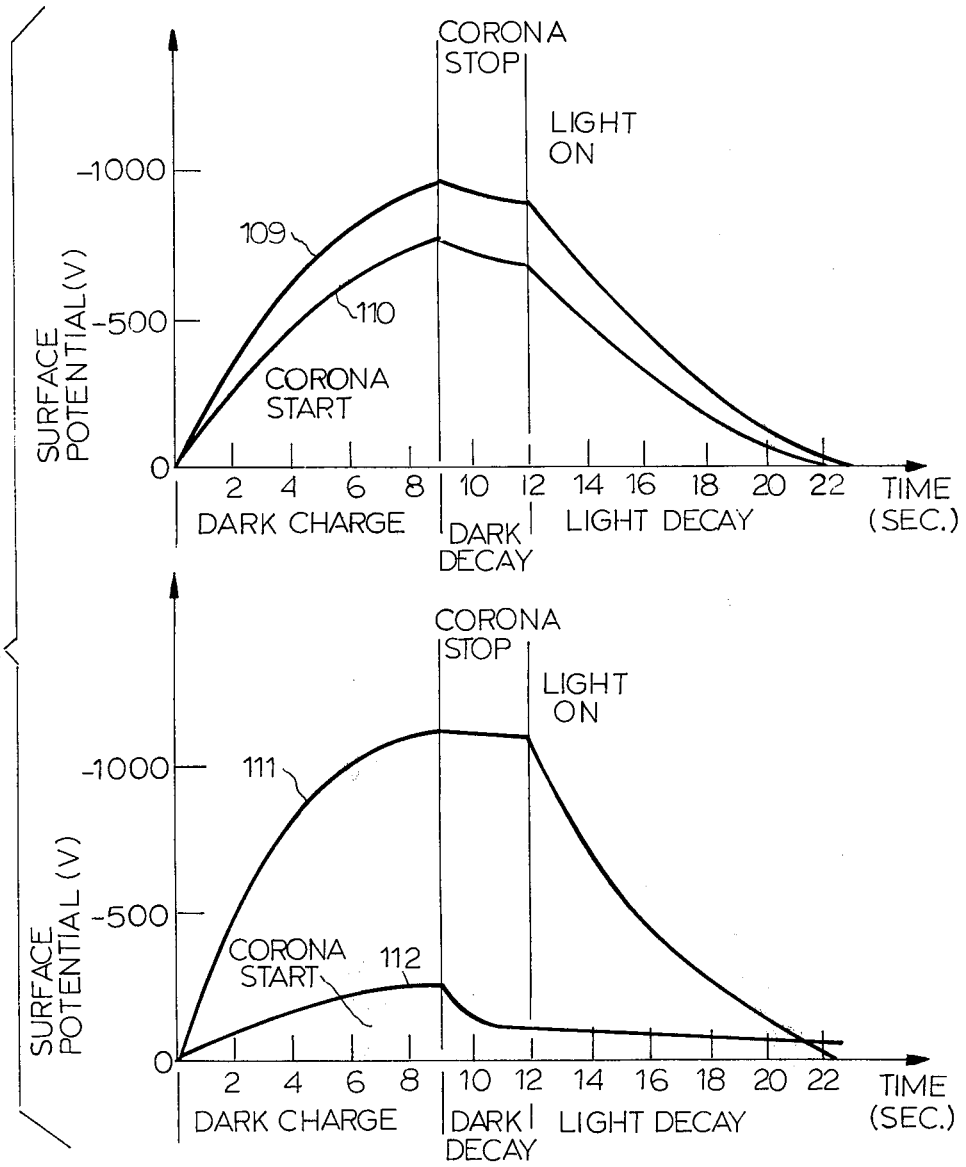

After samples M and N were completed, their characteristics (viz. charging in the dark,dark decay, and light decay) were examined. Then, samples M and N were placed in an atmosphere with a temperature of 50° C and a relative humidity of 90% RH for 50 hours for sample M, and 5 hours for Sample N, respectively. After aging, the electrophotographic properties were tested. FIGS. 8M and 8N show the properties of samples M and N, respectively, wherein curves 109 and 111 are those before aging and curves 110 and 112 are those after aging. As obvious from these figures, the properties of Sample M, which has a palladium layer under its photosensitive vitreous selenium layer, are more stable than those of sample N, which has no palladium layer.

EXAMPLE 5

PET Lumirror of 100 $\mu$ in thickness was used as the substrate sheet, and on to the surface of this film a palladium layer was coated by sputtering under the conditions which follow:

atmosphere: Ar gas charged chamber
pressure: $2 \times 10^{-2}$ mmHg
applied voltage between anode and cathod: 5 KV D.C.
distance between anode and cathode: 3 cm
anode: Cr plated copper plate
cathode: palladium metal plate Said film was placed in close contact with said copper plate. Another metallized PET was prepared by a conventional vacuum-coating of metallic aluminum.

These two kinds of metal coated films were cut to dimensions of A-4 (25.0 cm × 36.4 cm) and then were placed on a sample holder in a vacuum chamber which had two mutually independent heating vessels of molybdenum boat therein. The distance between the two boats was 1 cm. Into one boat a selenium metal particle of 99.99% purity was charged, and into the other boat tellurium metal powder of 99.99% purity was also charged. After evacuating the inside of said chamber to a vacuum of $1 \times 10^{-5}$ mmHg, said two boats were simultaneously heated gradually. At first, reddish-brown colored selenium vapor was coated onto the surface of both the palladium coated film and the aluminum coated film, then the mixed vapor which consisted of selenium and tellurium was coated. A condensed layer from the two vapors on both films showed a dark red color.

The adhesive property between said Se-Te alloy layer and palladium or aluminum coated film was tested by the test using the adhesive tape peeling method mentioned before. The adhesion between said alloy layer and palladium coated film was strong and they did not separate each from other, but the adhesion between said alloy layer and aluminum coated film was as weak as they separated easily each from other.

Then, the solution as shown in Table 6 was coated onto the surface of said Se-Te alloy layer and was dried for 5 hours in a hot air blast oven at 40° C. Thus, the organic topcoat layer of 12 $\mu$ in thickness was obtained. In the two completed samples, the one which includes palladium layer is an example of this invention, and it is named sample P hereinafter. The other sample which includes and aluminum layer is a reference sample and it is named Sample Q hereinafter.

Since a layer which contains poly-N-vinylcarbazole as a main ingredient is apt to shrink on drying, it inherently curls due to internal stress produced inside the layer thereof. In the case of the Sample $Q_1$, the Se-Te alloy layer in conjunction with the topcoat layer spontaneously separated from said aluminum layer in 10 hours, obviously due to an influence of this internal stress of the topcoat layer. On the contrary, the Sample P did not show such a separation. Moreover, the layers did not separate from each other even after it had been kept in the atmosphere of 40° C and 90% RH for 3 months.

Figure 9:
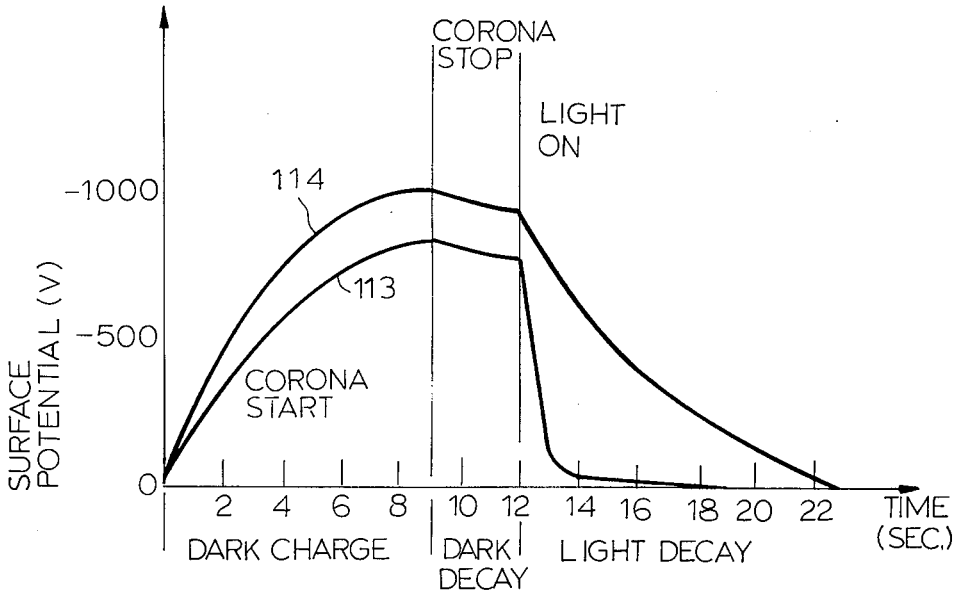
Figure 10:
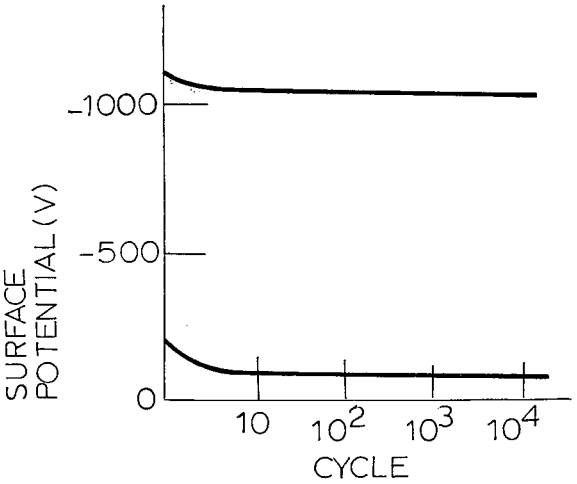

The electrophotographic property of the sample P is shown in FIG. 9, wherein a curve 113 shows the initial property thereof and a curve 114 shows an initial property of the Sample K for comparison with respect to photosensitivity. The repeating cycle test same as Test 1 was applied to the Sample P. The results are shown in FIG. 1:. As obvious from FIG. 10, Sample P shows almost no change in $V_o$ and $V_r$ until the 10,000th cycle.

EXAMPLE 6

Onto two sheets of PET of 100 $\mu$ in thickness, two kinds of electrodes were overlaid viz., one was laminated with a 50 $\mu$ thick aluminum foil and the other was vapor-coated with aluminum. The thickness of vapor-coated aluminum was 0.2 $\mu$. Both sheets in one batch were then overcoated with layers of 30A thick palladium 0.3 $\mu$ thick vitreous selenium by using the same method as described in Example 5. Further, the sheets were topcoated with the solution shown in Table 2 and dried. The dried thickness of the both sheets was 18 $\mu$.

Two experimental dual-layered photoreceptor samples thus obtained were subjected to the Tests 1, 2 and 3 as described before. The results of the tests were almost same as those of the Sample G in the both sheets. Using Test 4, two samples were subjected to a practical multi-copying test. From the copying test, the use-life (or printability) of the two samples were found to be about from 15,000 to 20,000 copies. If the samples exceeded the above copy times, they gradually colored to black and the corresponding copy image became foggy in background.

However, these samples gave excellent results compared with one which had no palladium layer under the selenium layer.

From the above observations, it is concluded that the presence of a thin palladium layer is very effective for preventing the vitreous selenium from crystallization. The adhesion between each layer was good and no delamination was observed by Test 6 in both samples.

To confirm the effectiveness of the presence of palladium layer, the microscopic test and X-ray analysis were applied to said samples which were kept in the atmosphere of temperature of 40° C and relative humidity of 95%. In the case of a sample having no palladium layer, the original color of vitreous selenium layer changed to black within a day or two. Further, white treelike micro crystals that seemed to be spherulites were observed in the black area of crystallized selenium. On the other hand, a sample in which a thin palladium layer was employed, showed no crystallization for more than 10 days, It can be considered that these results are very useful for practical purposes.

EXAMPLE 7

Palladium layers of seven degrees of thickness, viz 1, 5, 10, 30, 80, 1000 and 2000 A were overlaid onto a PET film Lumirror of 100 $\mu$ in thickness by the same sputtering method as that used for Example 2, where the thickness variation was controlled by adjusting the sputtering time. Then, the palladium coated surface was further coated with a vitreous selenium layer of 0.4$\mu$ in thickness by the vacuum evaporation method used for Example 2.

The seven kinds of selenium-palladium-PET film were stored in an oven at 40° C and a humidity of 95% RH in order to observe the change of the selenium layers which occurs with aging. The results were as follows: When the palladium layer was thicker than 2,000A, the vitreous selenium layer thereon changed its original color to black in two or three days, When the palladium layer was between 5A and 1000A in thickness, no color change or crystallization was observed. Especially, in the case of thicknesses between 10A and 80A, the color change was not observed even after 20 days of aging.

Concerning the adhesion problem between the palladium layer and the vitreous selenium layer, the sample having the palladium layer of 2000A in thickness was easily separated with the adhesive tape peeling test. After the test, the surface of the PET layer showed traces of palladium which had not totally adhered to the selenium layer. In the case of the other samples, the adhesion was found to be effective.

The sample having a 1 A thick palladium layer could not be used as an electrophotographic electrode because the surface resistivity thereof was found to be $10^{14}\Omega$/square. From the view point of electrical conductivity, a dual-layered photoreceptor for electrophotography could be made by replacing said PET film by an aluminum foil. However, such a thin palladium layer as 1 A in thickness could hardly prevent the vitreous selenium layer from crystallization.

What is claimed is:

1. An electrophotographic photoreceptor for producing an electrostatic latent image on the top layer thereof which comprises from the bottom up:

a. a substrate b. a layer of metallic palladium having a thickness of from 5A to 1000A, c. a layer including vitreous selenium having a thickness of from 0.05 to 3 microns and d. a top layer including polyvinyl carbazole having a recurring unit of the formula:

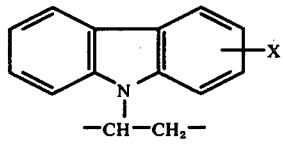

wherein X is a member selected from a group consisting of hydrogen, halogen, nitro, alkyl, aryl, alkyl aryl, amino and alkylamino.

2. An electrophotographic photoreceptor according to claim 1, wherein said palladium layer is deposited onto said substrate from a vapor thereof.

3. An electrophotographic photoreceptor according to claim 1, wherein said palladium layer is made by the sputtering process.

4. An electrophotographic photoreceptor according to claim 1, wherein said palladium layer has a thickness of from 10A to 100A.

5. An electrophotographic photoreceptor according to claim 1, wherein said substrate is a plastic film of a member selected from a group consisting of polyethylene terephthalate, polyethylene naphthalate, polycarbonate, polyimide, polyamide, polyimide-amide, cellulose acetate, polystyrene, polypropylene, polyethylene, polyvinyl chloride, acrylonitrile-butadiene-styrene(ABS), acrylonitrile-styrene(AS), polyacetal, epoxy, urethane, and heat-curing polyester.

6. An electrophotographic photoreceptor according to claim 1, wherein:

said substrate is a plastic film of a member selected from a group consisting of polyethylene terephthalate, polyethylene naphthalate, polycarbonate, polyimide, polyamide, polyimide-amide, cellulose acetate, polystyrene, polypropylene, polyethylene, polyvinyl chloride, acrylonitrile-butadiene-styrene (ABS), acrylonitrile-styrene(AS), polyacetal, epoxy, urethane and heat-curing polyester, and said palladium layer having a thickness of from 10A to 100A, which is deposited onto said substrate from a vapor thereof by a sputtering process.

7. An electrophotographic photoreceptor according to claim 1, wherein said substrate is electrically insulating.

8. An electrophotographic photoreceptor according to claim 1, wherein said substrate is electrically conductive.

* * * * *